US007647877B2

(12) United States Patent
Tseng

(10) Patent No.: US 7,647,877 B2
(45) Date of Patent: Jan. 19, 2010

(54) THREAD TAKE-UP LEVER FOR A SEWING MACHINE

(76) Inventor: Hsien-Chang Tseng, 1F, No. 11, Lane 125, Sec. 1, Kuo Kuang Road, Ta-Li City, Taichung Hsien (TW) 412

( * ) Notice: Subject to any disclaimer, the term of this patent is extended or adjusted under 35 U.S.C. 154(b) by 0 days.

(21) Appl. No.: 12/116,194

(22) Filed: May 6, 2008

(65) Prior Publication Data

US 2009/0277367 A1 Nov. 12, 2009

(51) Int. Cl.
*D05B 49/00* (2006.01)
*D05B 49/02* (2006.01)

(52) U.S. Cl. ..... 112/241

(58) Field of Classification Search ..... 112/241
See application file for complete search history.

(56) References Cited

U.S. PATENT DOCUMENTS 2,550,628 A * 4/1951 Webster ..... 112/241
3,310,015 A * 3/1967 Gegauf, Jr. ..... 112/245
3,545,392 A * 12/1970 Fresard ..... 112/241
4,070,976 A * 1/1978 Taketomi ..... 112/241
4,263,859 A * 4/1981 Johnson ..... 112/184
4,341,171 A * 7/1982 Johnson ..... 112/250
5,069,150 A * 12/1991 Ogawa ..... 112/241
5,441,003 A * 8/1995 Hashiride ..... 112/259

* cited by examiner

*Primary Examiner*—Ismael Izaguirre
(74) *Attorney, Agent, or Firm*—Banger Shia

(57) ABSTRACT

A thread take-up lever for a sewing machine is mounted on the sewing machine and can prevent a thread from disengaging from a thread-receiving portion. The thread take-up lever is disposed with a C-shaped thread-receiving portion having an open recess. Adjacent to the open recess is provided at least one positioning portion for fixing a thread-stopping member. One end of the thread-stopping member is fixed to the positioning portion, and an elastic stopping portion extends from the other end of the thread-stopping member. The stopping portion is formed with a free end abutted against an inner periphery of the open recess. The free end can be pushed away by the thread, and then the free end will automatically return to its original position immediately to abut against the open recess again, thus forming a structure to prevent the thread from disengaging from the thread-receiving portion.

8 Claims, 8 Drawing Sheets

THREAD TAKE-UP LEVER FOR A SEWING MACHINE

BACKGROUND OF THE INVENTION

1. Field of the Invention

The present invention relates to a thread take-up lever for a sewing machine, and more particularly to a thread take-up lever which can really prevent a thread from disengaging from a thread-receiving portion. An open recess of the thread-receiving portion of the thread take-up lever is disposed with an elastic thread-stopping member, so that the thread can indeed enter the thread-receiving portion in one direction and is prevented from disengaging from the thread-receiving portion in the other direction.

2. Description of the Prior Art

At present, the thread take-up lever for a sewing machine has various forms and structures, and a structure of which for preventing a thread is prevented from disengaging from a thread-receiving portion is the main structure that needs to be improved. Currently, the relevant invention has also been disclosed in TW patent application M 2499621 "a thread take-up lever for a sewing machine for preventing a thread from disengaging from a thread-receiving portion". Referring to FIG. 8, a thread take-up lever is folded and formed as one piece, and a thread guide end 91 is folded on the upper thread take-up lever to form a long and narrow thread-receiving portion 92 with respect to the body of the thread take-up lever 90 for preventing the thread from disengaging from the thread-receiving portion 92. On an upper side of the thread guide end 91 is defined a concave surface 910 for reception of a clip 93 to form a blocking end 930, the blocking end 930 is defined with a concave portion 931 for preventing the thread from disengaging from the thread-receiving portion 92, one end of the concave portion 931 is closed while the other end is open. In order to prevent the thread from disengaging from the thread-receiving portion 92, the thread-receiving portion 92 is designed to form a long and narrow passage. However, since said long and narrow passage is made of metal and produced by press forming, it is hard to trim the rough edge 920 formed in the passage due to a limitation of such long and narrow space. Thus the thread is unable to enter the passage, and the thread will be cut down and scratched easily due to such rough edge 920. After the thread is scratched, the thread is likely to be broken by the thread take-up lever, and the sewing machine must be threaded again, so that not only the time will be wasted, but also the quality of the product will be affected.

The thread take-up lever is additionally defined with a clip, and the blocking end of the clip is located at one side of the thread guide. A large interspace is formed between the blocking end and the thread guide, so the thread is likely to fall off the thread-receiving portion 92.

In addition, the conventional technology cited in the above-mentioned invention is such that the thread guide end is folded, the structure can not prevent the thread from disengaging from the thread-receiving portion 92, so an elastic linear member is defined on one side of the thread guide end for preventing the thread from disengaging from the thread-receiving portion 92. However, the unnecessary interspace will be formed in such a structure so that the thread will disengage therefrom easily.

The present invention has arisen to mitigate and/or obviate the afore-described disadvantages.

SUMMARY OF THE INVENTION

The primary objective of the present invention is to provide a thread take-up lever for a sewing machine, an open thread-receiving portion is disposed at a front end of the thread take-up and is adjacent to an open recess. A thread-stopping member extends from an outside to an inside of the open recess, and one end of the thread-stopping member is fixed at one end of the open recess. An elastic stopping portion is formed with a free end extending towards the other end of the open recess, and the free end is abutted against an inner periphery of the open recess, so that the open recess of the thread-receiving portion is closed by the elastic stopping portion to prevent the thread from disengaging from the thread-receiving portion.

The present invention is characterized in that: due to its elastic property, the elastic free end of the thread-stopping member is deformable when subjected to a pressure, so that a user can pull a thread tight and directly push the elastic free end downward with the tight thread, making the elastic free end of the stopping portion deform and move away from the inner periphery of the open recess of the thread-receiving portion, and thus the open recess of the thread-receiving portion is opened and naturally, the thread is pushed into it, and then, the elastic free end of the stopping portion recovers and closes the open recess of the thread-receiving portion so as to prevent disengagement of the thread out of the thread-receiving portion, in other words, with only one pushing movement of the user, the thread is moved into the open recess of the thread-receiving portion and restricted therein.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
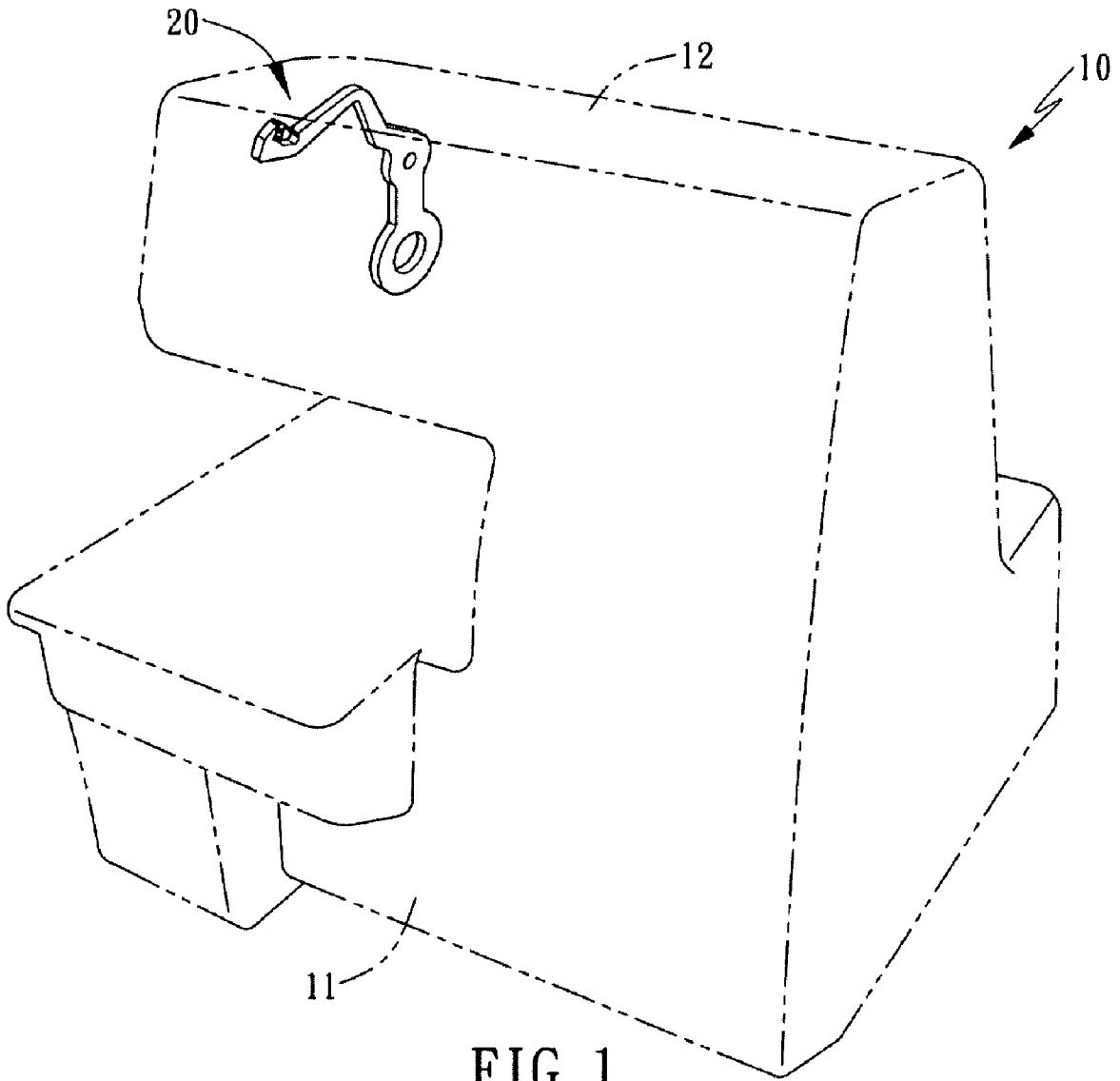
FIG. 1 is a perspective view of a sewing machine in accordance with a first embodiment of the present invention.
Figure 2:
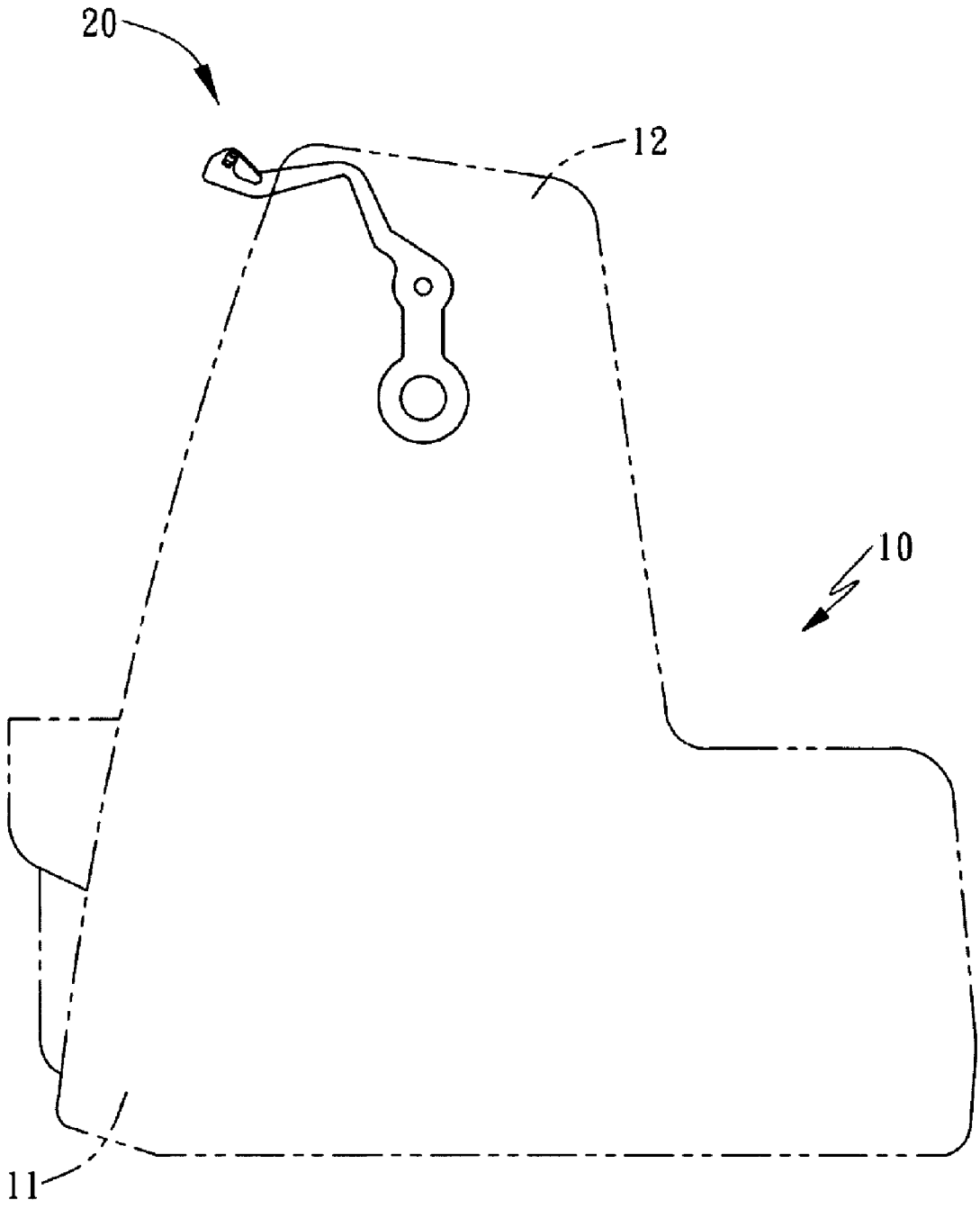
FIG. 2 is a side view showing that the sewing machine is provided with a thread take-up lever in accordance with the first embodiment of the present invention.
Figure 3:
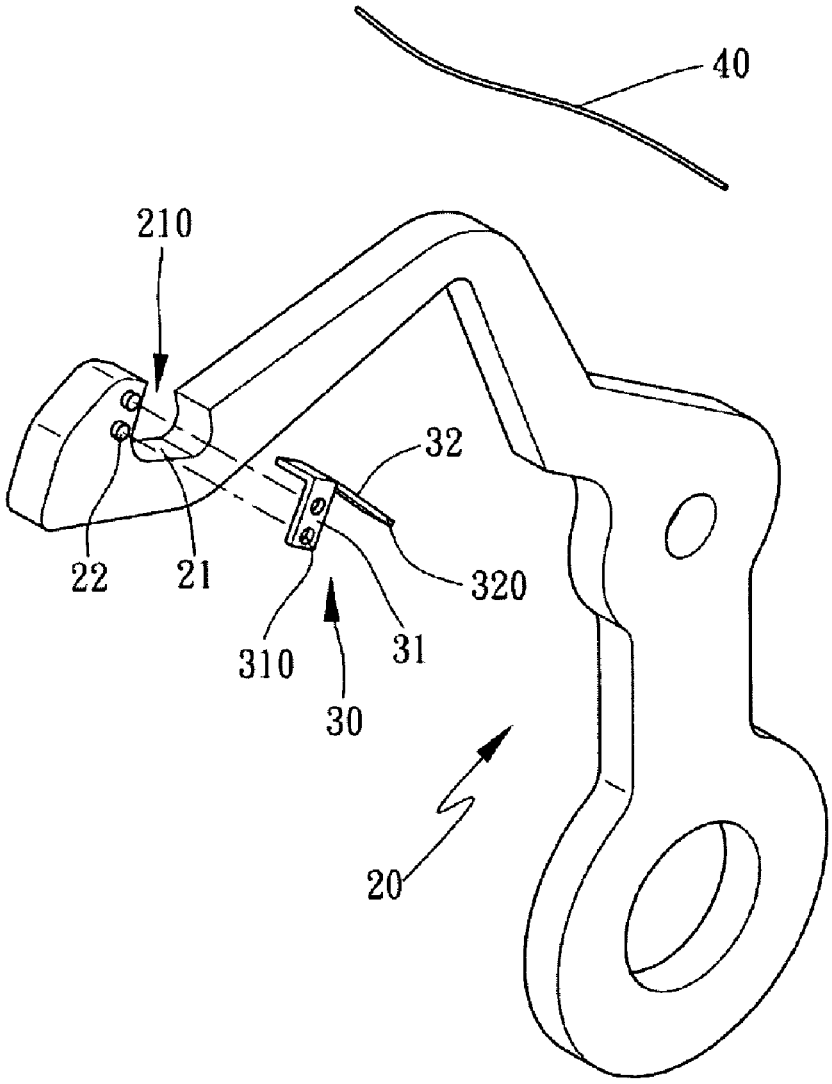
FIG. 3 is an exploded view of the thread take-up lever in accordance with the first embodiment of the present invention.

Referring to FIGS. 1, 2 and 3, a sewing machine 10 in accordance with a first embodiment of the present invention comprises a machine bed 11 and a horizontal arm 12. The horizontal arm 12 is provided with a thread take-up lever 20 on whose front end is disposed a thread-receiving portion 21 having a laterally open recess 210. Adjacent to the open recess 210 is provided at least one positioning portion 22, the positioning portion 22 is cylinder-shaped, as shown in figure for fixing one end of a thread-stopping member 30, and the other end of the thread-stopping member 30 is folded to close a top side of the open recess 210 and abutted against an inner periphery of open recess 210 of the thread-receiving portion 21, so that the open recess of the thread-receiving portion 21 is closed in one direction.

The thread-stopping member 30 comprises a fixing end 31 which is abutted against one side of the thread take-up lever 20, and the fixing end 31 is provided with a fixing portion 310 in the form of a through hole for insertion of the poisoning portion 22, so that the thread-stopping member 30 can be fixed to the thread take-up lever 20. A number of the positioning portion 22 is the same as a number of the fixing portion 310.

A stopping portion 32 extends from the fixing end 31 of the thread-stopping member 30 to close the top side of the open recess 210, the stopping portion 32 extends from the outside to the inside of the open recess 210, one end of the stopping portion 32 is formed with an elastic free end 320 abutted against an inner periphery of the open recess 210 so that the free end 320 is only allowed to move into the thread-receiving portion 21 without moving out of the open recess 210.

Figure 4:
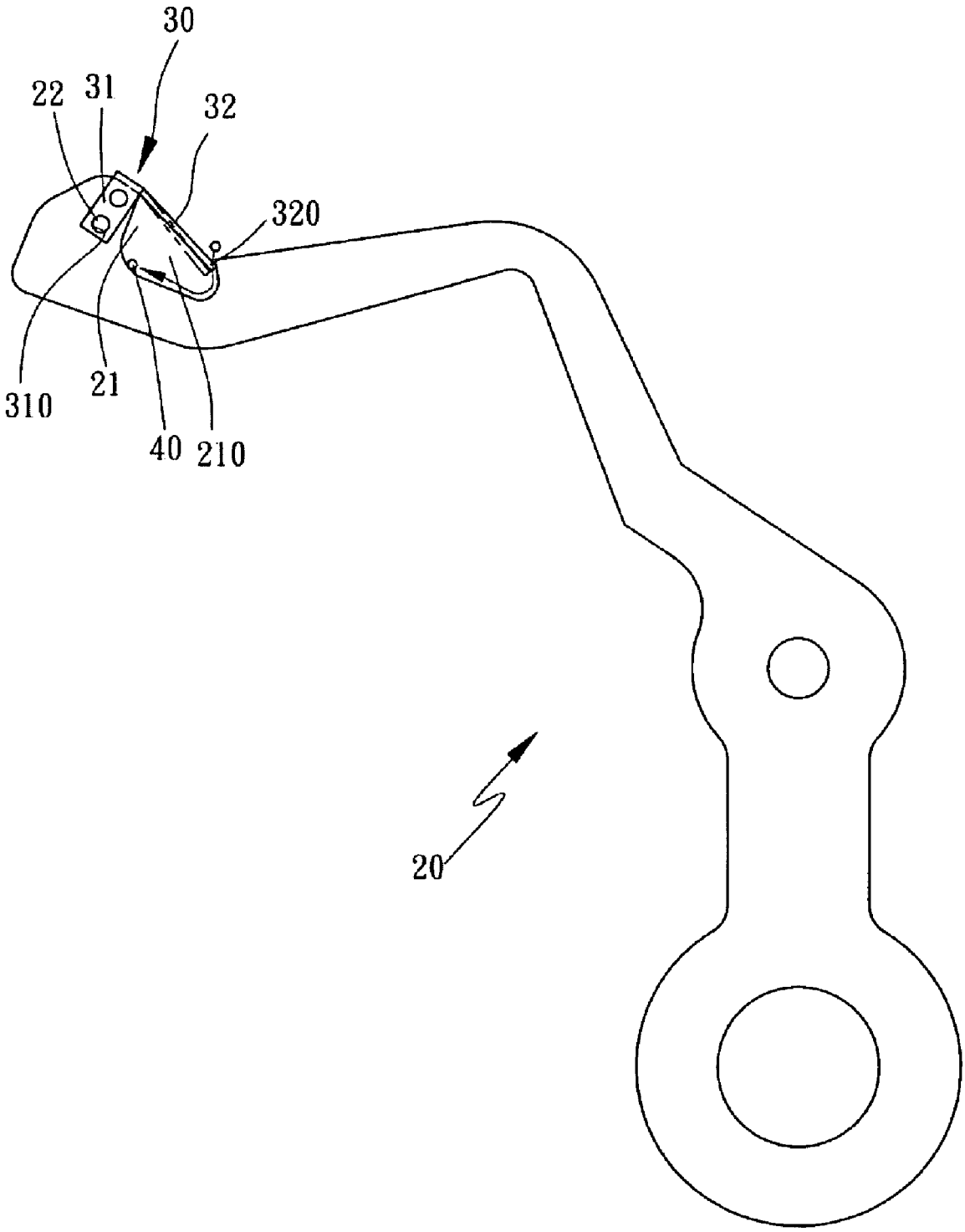
FIG. 4 is a side view showing that a thread-stopping member is assembled on a thread take-up lever in accordance with the first embodiment of the present invention.

Referring to FIG. 4, when a thread 40 enters the thread-receiving portion 21 from the outside of the open recess 210 of the thread-receiving portion 21, the thread 40 can push away the free end 320 to enter the thread-receiving portion 21, and then the free end 320 will automatically return to its original position immediately to abut against the open recess 210 again, so that the stopping portion 32 of the thread-stopping member 30 can indeed close the open recess 210, and the thread 40 is not allowed to slide off the thread-receiving portion 21.

Figure 5:
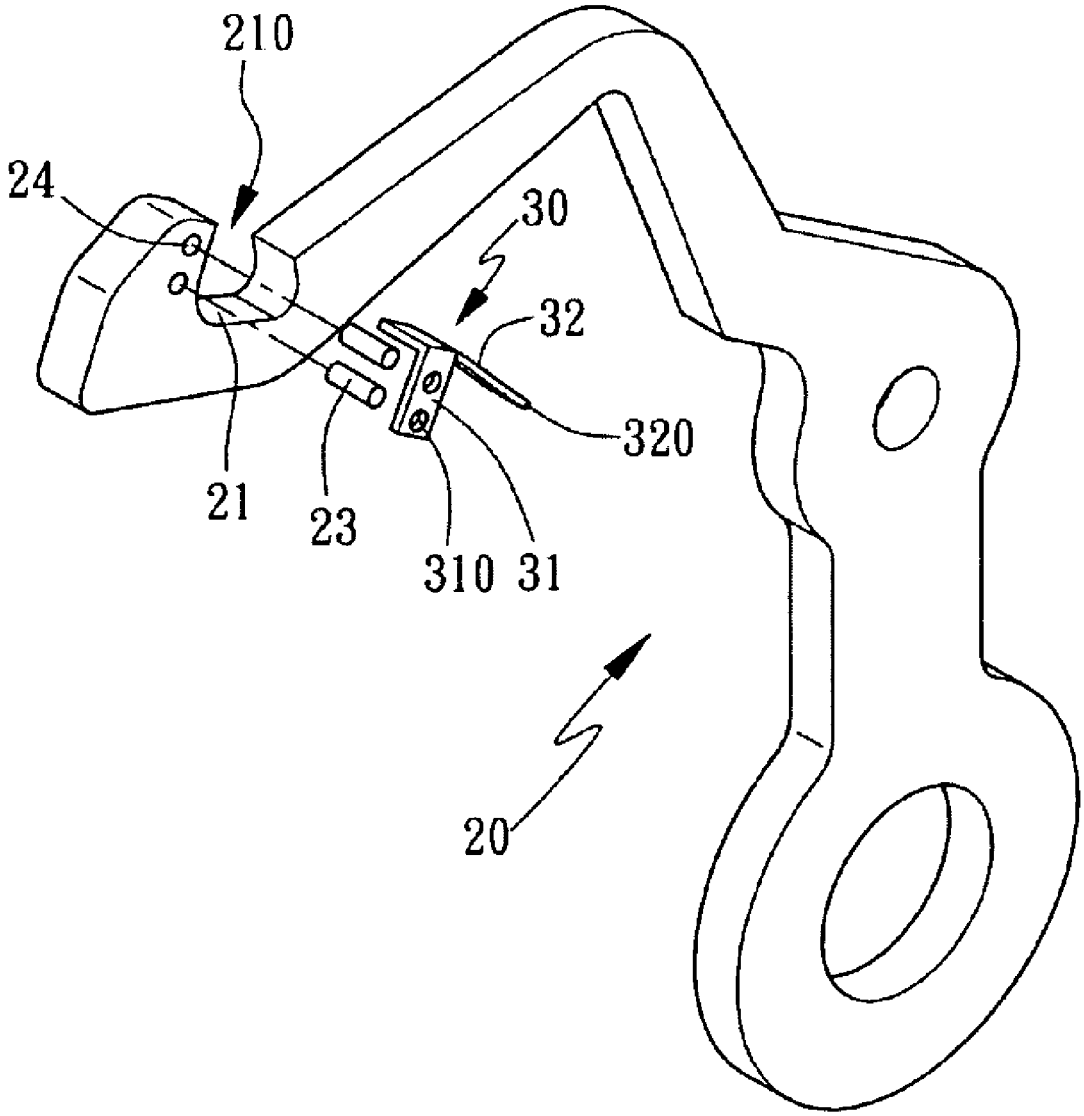
FIG. 5 is an exploded view of the sewing machine in accordance with a second embodiment of the present invention.
Figure 6:
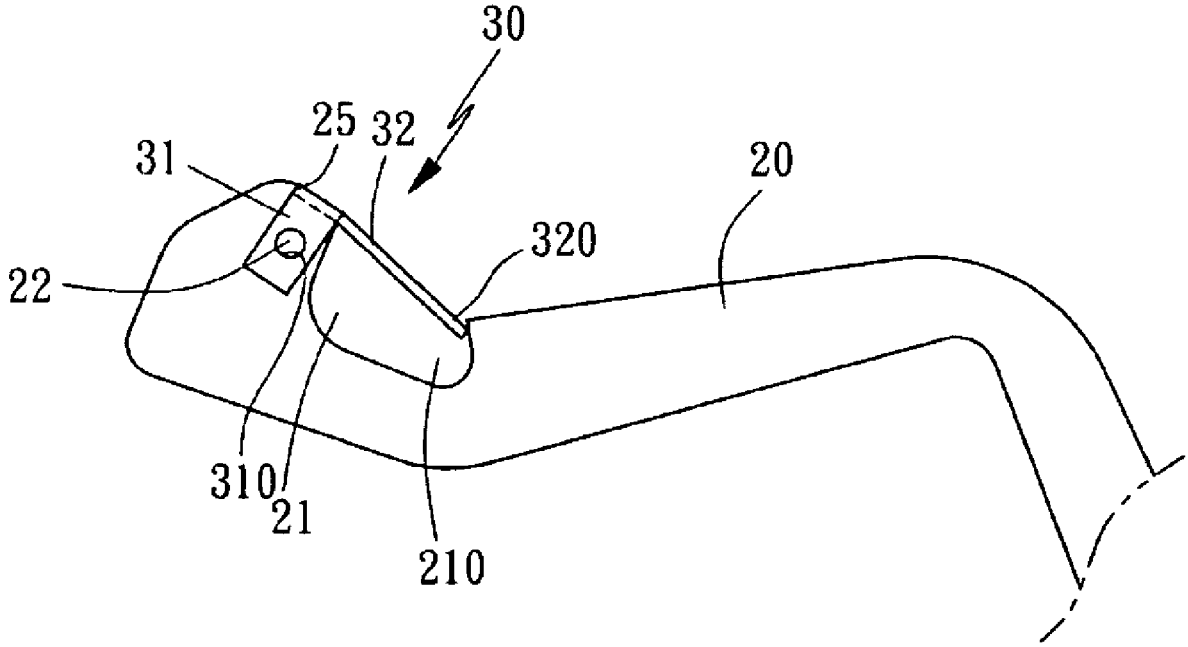
FIG. 6 is a view showing that the thread-stopping member is assembled on the thread take-up lever in accordance with a third embodiment of the present invention.
Figure 7:
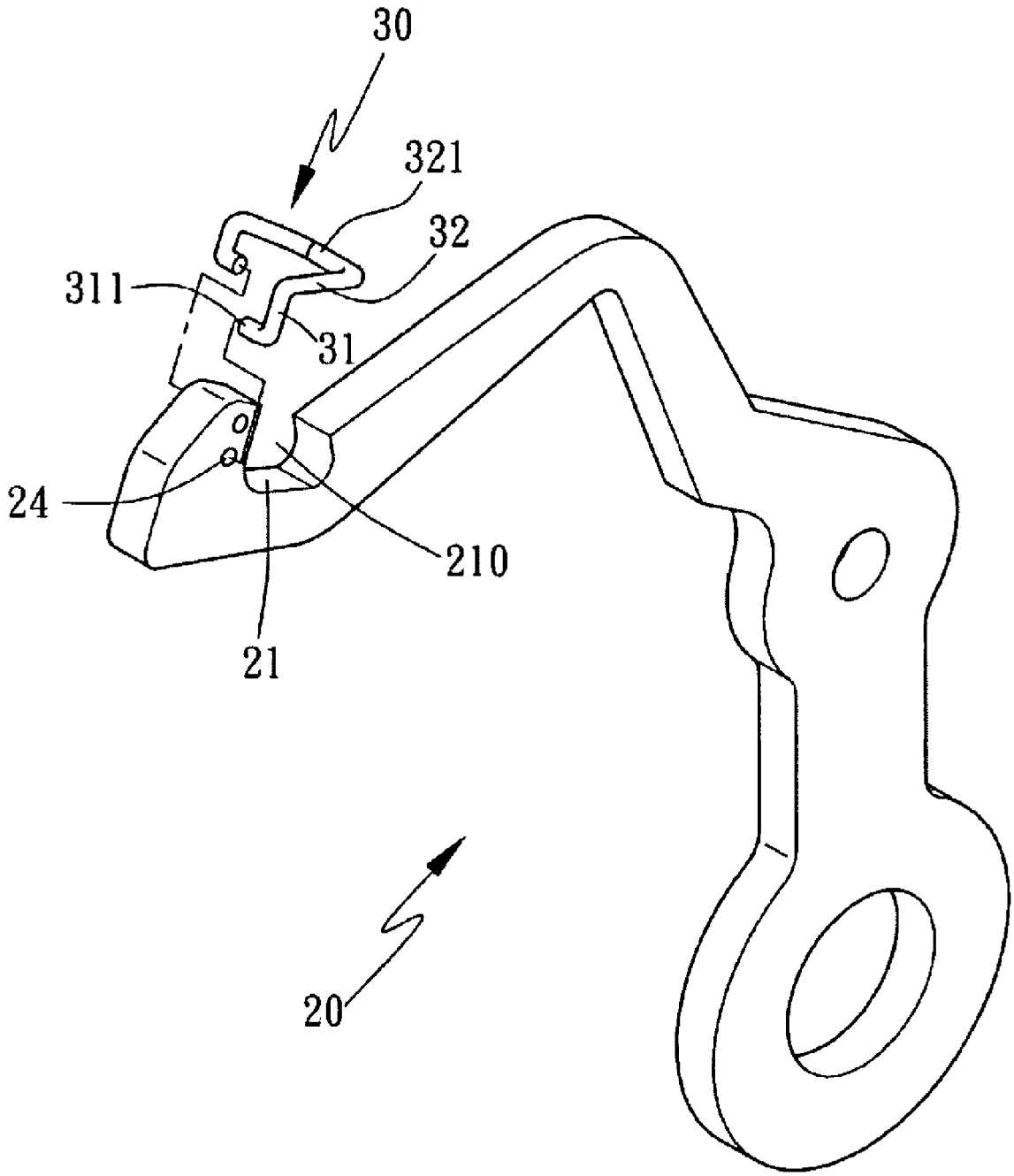
FIG. 7 is a three-dimensional exploded view of the sewing machine in accordance with the third embodiment of the present invention.
Figure 8:
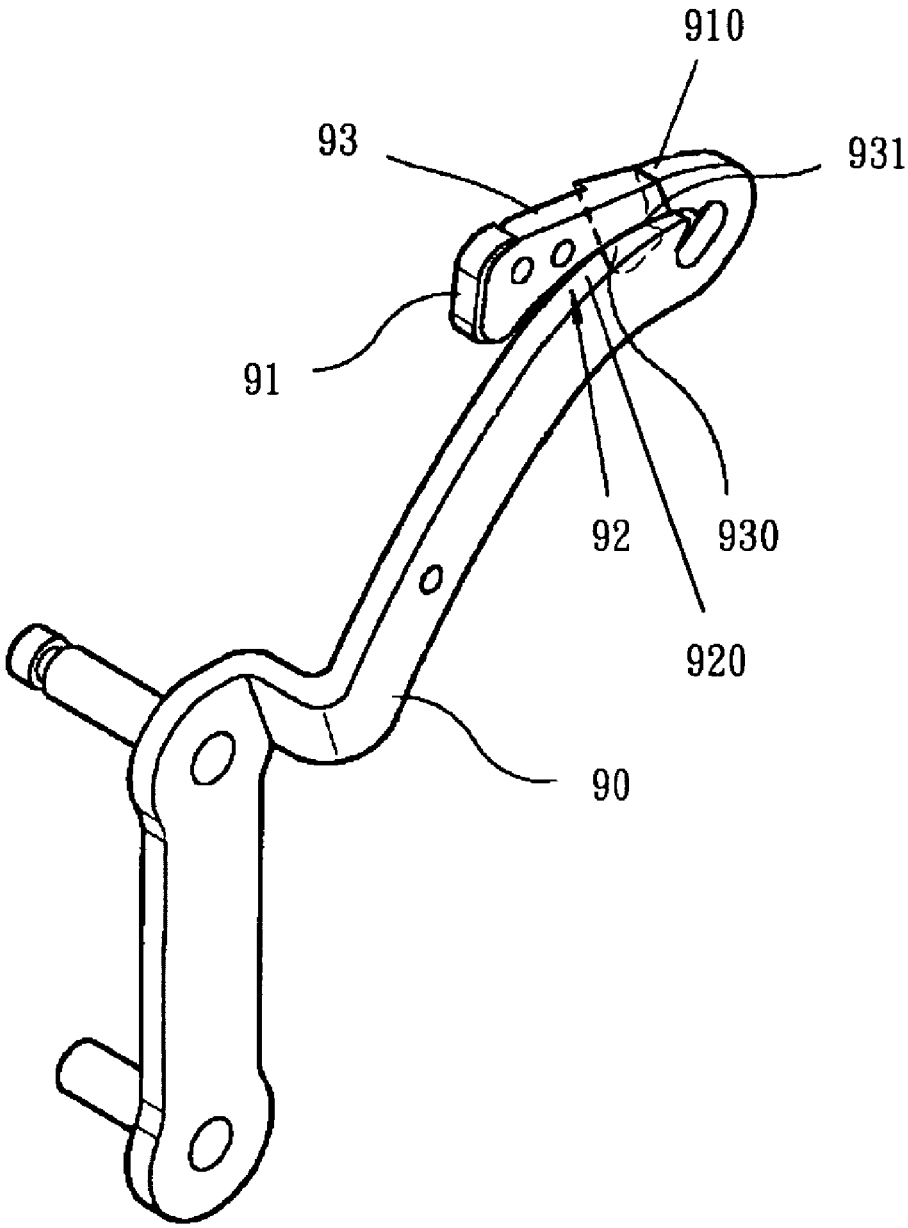
FIG. 8 is a three-dimensional view of the sewing machine in accordance with the conventional invention.

A second embodiment of the sewing machine can also be as shown in FIG. 5, the abovementioned positioning portion 22 can be replaced with a rivet 23 and a through hole 24, and the same function can be achieved. A third embodiment of the sewing machine is as shown in FIG. 6, adjacent to a front edge of the positioning portion 22 of the thread take-up lever 20 is provided a groove 25, and the fixing end 31 of the thread-stopping member 30 is folded to form a stopping portion 32 which is inserted into the groove 25 for fixing the thread-stopping member 30. In addition, a fourth embodiment of the sewing machine is as shown in FIG. 7, the thread-stopping member 30 can be a folded linear elastic member, and the thread-stopping member 30 is roughly U-shaped and has an inverse L-shaped side. The two fixing ends 31 are different in length, one is long and the other is short, respectively, and folded to form a positioning portion 311. A free end 321 of the stopping portion 32 of the thread-stopping member 30 is in the form of a horizontal arm to abut against an inner periphery of the open recess 210 of the thread-receiving portion 21, and through holes 24 are defined in the thread take-up lever 20 for insertion of the positioning portion 311 of the thread-stopping member 30, respectively. Thus, a support point and resistance point are formed in the thread take-up lever 20, respectively. The free end 321 of the stopping portion 32 is abutted to an inner periphery of the open recess 210, so that the open recess 210 is closed completely.

While we have shown and described various embodiments in accordance with the present invention, it is clear to those skilled in the art that further embodiments may be made without departing from the scope of the present invention.

What is claimed is:

1. A thread take-up lever for a sewing machine, comprising:

a thread-receiving portion being disposed on a front end of a thread take-up lever for receiving a thread, the thread-receiving portion having an open recess, an elastic thread-stopping member being disposed at the open recess; and the thread-stopping member being provided with a stopping portion extending from a fixing end of the thread-stopping member to close a top side of the open recess, the stopping portion extending from an outside to an inside of the open recess;

wherein one end of the stopping portion of the thread-stopping member is formed with an elastic free end which abuts against an inner periphery of the open recess of the thread-receiving portion, so that the free end is only allowed to move into the thread-receiving portion without moving out of the open recess in such a manner that when a thread enters the thread-receiving portion from the outside of the open recess of the thread-receiving portion, the thread can push away the free end to enter the thread-receiving portion, and then the free end will automatically return to its original position immediately to abut against the open recess again, so that the stopping portion of the thread-stopping member can indeed close the open recess, and the thread is not allowed to slide off the thread-receiving portion.

2. The thread take-up lever as claimed in claim 1, wherein the thread take-up lever is disposed with a positioning portion, and the thread-stopping member is disposed with a fixing portion, the positioning portion is inserted into the fixing portion.

3. The thread take-up lever as claimed in claim 2, wherein the positioning portion is a protruding post, and the fixing portion is a through hole for insertion of the protruding post.

4. The thread take-up lever as claimed in claim 2, wherein the positioning portion is cylinder-shaped, and the fixing portion is a through hole.

5. The thread take-up lever as claimed in claim 2, wherein the positioning portion of the thread take-up lever is in the form of a rivet and a through hole.

6. The thread take-up lever as claimed in claim 2, wherein a groove is defined adjacent to an edge of the positioning portion of the thread take-up lever, and a fixing end of the thread-stopping member is folded to form the stopping portion which is inserted into the groove.

7. The thread take-up lever as claimed in claim 1, wherein the thread-stopping member is a folded linear elastic member, the thread-stopping member comprises a fixing end which is fixed to the thread take-up lever, one end of the fixing end is provided with the fixing portion, the stopping portion extends from the other end of the fixing end, one end of the stopping portion is formed with a free end being adjacent to the open recess, the thread take-up lever is provided with a positioning portion for fixing the fixing portion of the thread-stopping member.

8. A thread take-up lever for a sewing machine, comprising:

a thread-receiving portion being disposed on a front end of a thread take-up lever for receiving a thread, the thread-receiving portion having an open recess, an elastic thread-stopping member being disposed at the open recess; and the thread-stopping member being provided with a stopping portion to close the open recess of the thread-receiving portion so as to prevent the thread from disengaging from the thread-receiving portion;

wherein the thread take-up lever is disposed with a positioning portion, and the thread-stopping member is disposed with a fixing portion, the positioning portion is inserted into the fixing portion;

a groove is defined adjacent to an edge of the positioning portion of the thread take-up lever, and a fixing end of the thread-stopping member is folded to form the stopping portion which is inserted into the groove.

* * * * *